US012692786B2

(12) United States Patent
Poizat et al.

(10) Patent No.: US 12,692,786 B2
(45) Date of Patent: Jul. 28, 2026

(54) SAMPLING THROUGH PERFORATION GUNS WITH FLUSHING

(71) Applicant: Schlumberger Technology Corporation, Sugar Land, TX (US)

(72) Inventors: Jeremie Poizat, Houston, TX (US); Karthik Kundapur, Rosharon, TX (US); Arunkumar Arumugam, Rosharon, TX (US); Vinod Chakka, Rosharon, TX (US); Yuxiang Liu, Rosharon, TX (US); Juan Carlos Luna Diaz, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/202,253

(22) Filed: May 8, 2025

(65) Prior Publication Data

US 2025/0347223 A1 Nov. 13, 2025

Related U.S. Application Data

(60) Provisional application No. 63/644,304, filed on May 8, 2024, provisional application No. 63/644,247, filed on May 8, 2024, provisional application No. 63/644,219, filed on May 8, 2024.

(51) Int. Cl.
*E21B 49/08* (2006.01)

(52) U.S. Cl.
CPC ..... *E21B 49/084* (2013.01); *E21B 49/0813* (2020.05); *E21B 49/086* (2013.01)

(58) Field of Classification Search
CPC ... E21B 49/0813; E21B 49/084; E21B 49/086
See application file for complete search history.

(56) References Cited

U.S. PATENT DOCUMENTS 5,467,823 A * 11/1995 Babour ..... E21B 33/14 166/250.07
7,637,318 B2 * 12/2009 Sierra ..... E21B 47/06 166/308.1
8,540,027 B2 9/2013 Wesson
8,684,084 B2 4/2014 Wesson
(Continued)

FOREIGN PATENT DOCUMENTS

WO 2003100218 A1 12/2003

*Primary Examiner* — Nicole Coy
*Assistant Examiner* — Nicholas D Wlodarski
(74) *Attorney, Agent, or Firm* — Kyle R. Miiller

(57) ABSTRACT

A system includes a casing configured to mount within an open hole of a wellsite and a monitoring system configured to mount outside of the casing and monitor a geological formation. The monitoring system includes a perforating device outside of the casing, where the perforating device is configured to produce one or more perforations into the geological formation outside of the casing in a perforating operation of the monitoring system, where the one or more perforations are configured to enable fluid flow between the geological formation and the monitoring system. The system also includes a fluid circuit outside of the casing, where the fluid circuit is coupled to the perforating device, and the fluid circuit is configured to route a first fluid from the geological formation to a sample collecting system during a sampling operation of the monitoring system.

9 Claims, 9 Drawing Sheets

(56) References Cited

U.S. PATENT DOCUMENTS

| | | | | |
|---|---|---|---|---|
| 8,783,369 | B2 | 7/2014 | Rioufol | |
| 9,926,755 | B2 | 3/2018 | Van Petegem | |
| 9,970,286 | B2 * | 5/2018 | Godager | E21B 49/00 |
| 11,136,461 | B2 | 10/2021 | Kokel | |
| 12,312,902 | B2 | 5/2025 | Roselier | |
| 2003/0164037 | A1 * | 9/2003 | Moffatt | E21B 43/11 73/152.46 |
| 2012/0048539 | A1 * | 3/2012 | Clark | E21B 47/06 166/250.01 |
| 2025/0003313 | A1 * | 1/2025 | Jones | E21B 49/00 |
| 2025/0346430 | A1 | 11/2025 | Guven | |

* cited by examiner

SAMPLING THROUGH PERFORATION GUNS WITH FLUSHING

CROSS-REFERENCE TO RELATED APPLICATION

The present application is a U.S. Non-Provisional Patent application claiming benefit of U.S. Provisional Patent Application No. 63/644,247, entitled "SAMPLING THROUGH PERFORATION GUNS WITH FLUSHING", filed May 8, 2024, U.S. Provisional patent Application No. 63/644,219 entitled "CCS ZONAL INTEGRITY AND SEALING SYSTEMS", filed May 8, 2024, and U.S. Provisional Patent Application No. 63/644,304, entitled "SYSTEMS AND METHODS OF INTEGRATED FLUID INJECTION MONITORING", filed May 8, 2024, which are herein incorporated by reference.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Industrial plants often combust hydrocarbon-containing materials, such as coal, oil, and natural gas, to generate heat and/or power for various equipment and/or processes. Flue gas is generated as a byproduct of the combustion process and may be treated prior to being released into the atmosphere. For example, carbon capture, utilization, and storage (CCUS) refers to a set of technologies and processes designed to capture carbon dioxide ($CO_2$) emissions from industrial processes or power generation, utilize the captured $CO_2$ in various applications, and store the $CO_2$ underground to limit it from entering the atmosphere and contributing to climate change. In conventional CCUS operations, monitoring and verification of $CO_2$ storage often involves the installation and maintenance of dedicated monitoring wells that are used to assess the integrity of the storage site and to detect any potential leaks of the stored $CO_2$. However, the installation and maintenance of these dedicated monitoring wells can add significant costs to CCUS projects.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a system includes a casing configured to mount within an open hole of a wellsite and a monitoring system configured to mount outside of the casing and monitor a geological formation. The monitoring system includes a perforating device outside of the casing, where the perforating device is configured to produce one or more perforations into the geological formation outside of the casing in a perforating operation of the monitoring system, where the one or more perforations are configured to enable fluid flow between the geological formation and the monitoring system. The system also includes a fluid circuit outside of the casing, where the fluid circuit is coupled to the perforating device, and the fluid circuit is configured to route a first fluid from the geological formation to a sample collecting system during a sampling operation of the monitoring system.

In another embodiment, a system includes a monitoring system configured to mount outside of a casing within an open hole of a wellsite and monitor a geological formation. The monitoring system includes a perforating device outside of the casing, where the perforating device includes an initiation device configured to activate a perforating gun to produce one or more perforations into the geological formation outside of the casing in a perforating operation of the monitoring system, where the one or more perforations are configured to enable fluid flow between the geological formation and the monitoring system. The system also includes a fluid circuit outside of the casing, where the fluid circuit is configured to route a first fluid from the geological formation to one or more sensors or gauges to monitor one or more properties of the first fluid.

In a further embodiment, a method for operating a monitoring system to sample a first fluid includes, in a perforating operation of the monitoring system, increasing a pressure of a second fluid within a U-tube of the monitoring system to activate a perforating device of the monitoring system, where upon activation of the perforating device, a perforating gun of the perforating device is configured to produce one or more perforations extending from the perforating gun into a geological formation. The method also includes, after the perforating operation of the monitoring system, sampling, via a sampling operation of the monitoring system, where the sampling operation includes decreasing the pressure of the second fluid within the U-tube of the monitoring system to enable flow of the first fluid from the geological formation into the monitoring system.

In a further embodiment, a dual expandable packer system including an upper expandable metal packer and a lower expandable metal packer disposed around a tubular. The upper expandable metal packer and the lower expandable metal packer has a port to convey fluid to expand the upper expandable metal packer and the lower expandable metal packer into sealing engagement with a borehole wall. The ports may have a pressure control device, e.g. a one-way valve, utilized to inflate the expandable packer. An elastomer may be located on the outer surface of the expandable metal packer. The dual expandable packer system has a bypass passage that allows fluid or cement to pass from a bottom side of a lower expandable packer to a top side of an upper expandable packer.

In a further embodiment, a dual expandable packer system including an upper expandable metal packer and a lower expandable metal packer disposed around a tubular. An elastomer may be located on the outer surface of the expandable metal packer. The upper expandable metal packer and the lower expandable metal packer has one or more control lines to expand the upper expandable metal packer and the lower expandable metal packer into sealing engagement with a borehole wall. The one or more control line supply fluid utilized to inflate the expandable packer. The one or more control lines may be connected to sensors to provide power supply or transmit the information from the sensors. The dual expandable packer system has a bypass passage that allows fluid or cement to pass from a bottom side of a lower expandable packer to a top side of an upper expandable packer.

In a further embodiment, a method of cementing an annulus created by a wall of a well bore wall and a dual expandable packer system comprises placing the dual expandable packer system at a desired location within the wellbore. Expanding an upper expandable metal packer and a lower expandable metal packer of the dual expandable packer system creating a seal between the wellbore wall and the dual expandable packer system. Conveying a cement slurry through a liner of the dual expandable packer system up the annulus. Conveying the cement slurry in the annulus through a bypass passage of the dual expandable packer system into the annulus above the dual expandable packer system.

BRIEF DESCRIPTION OF THE DRAWINGS

Various aspects of this disclosure may be better understood upon reading the following detailed description and upon reference to the drawings in which:

FIG. 8 is a cross-sectional diagram of a dual expansion packer system with a fluid bypass passage, in accordance with an aspect of the present disclosure.

DETAILED DESCRIPTION

Figure 1:
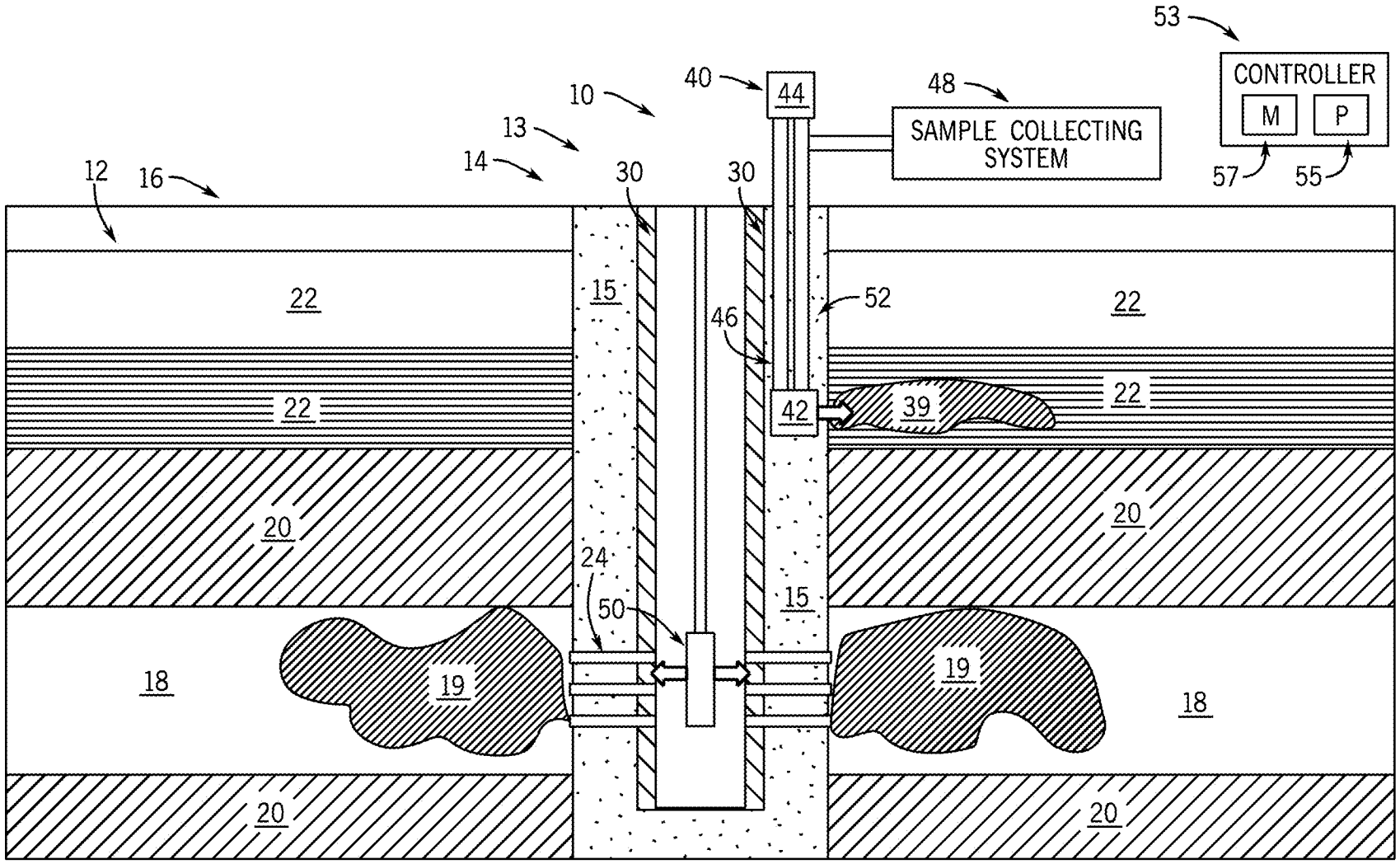
FIG. 1 is a schematic illustration of an embodiment of a carbon capture, utilization, and storage system including a monitoring system, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Carbon capture, utilization, and storage (CCUS) refers to a set of technologies and processes designed to capture carbon dioxide ($CO_2$) emissions from industrial processes or power generation, utilize the captured $CO_2$ in various applications, and store the $CO_2$ to limit the $CO_2$ from entering the atmosphere and contributing to climate change. For example, $CO_2$ may be captured from various sources and/or processes and transported to a location for injection into an underground geological formation (e.g., storage site). The underground geological formation may include various layers with differing characteristics that enable the geological formation to store the $CO_2$ in the subsurface rock. For example, the geological formation may include one or more porous layers (e.g., permeable layer, porous reservoir, deep saline formation or layer, deep saline aquifer, depleted hydrocarbon formation or layer), one or more sealing rock layers (e.g., caprocks, impermeable layer), as well as additional layers (e.g., drinking aquifer). The $CO_2$ may be injected into the one or more porous layers (e.g., into a storage site), and the one or more sealing layers may be positioned above and/or below the one or more porous layers to seal the one or more porous layers, thereby preventing carbon dioxide injected into the porous layers from reaching the additional layers and/or the atmosphere.

The storage operations may further include monitoring the well and/or the storage site for extended periods of time to ensure that the integrity of the storage site is maintained and/or to identify potential leaks of the stored $CO_2$ that may affect the various layers positioned above and/or below the storage site. For example, in traditional CCUS operations, monitoring and verification of $CO_2$ storage often involves the installation and maintenance of dedicated monitoring wells, which may be distinguishable from injection wells in that the dedicated monitoring wells are not configured to inject $CO_2$ into the geological reservoir. Rather, these dedicated monitoring wells are drilled through the geological formation within a threshold distance from the injection well and are used to assess the integrity of the storage site and/or to detect any potential leaks of the stored $CO_2$. For example, the dedicated monitoring wells may monitor the one or more sealing layers for the presence of $CO_2$, which may be indicative of a potential issue at the storage site. Unfortunately, the installation and maintenance of these dedicated monitoring wells can add significant costs to CCUS projects and/or operations.

Additionally, or alternatively, traditional CCUS operations may employ monitoring lines along a length of a casing of an injection well to monitor and/or verify the injection well (e.g., assess the integrity of the storage site). The monitoring lines may be fiber optic, electric, and/or optical telemetry cables, tubing-encased fiber optic line (TEF), tubing-encased cable (TEC), or any combination thereof. The monitoring lines may be positioned in the annular space extending between the casing and the geological formation from the surface to the open hole. To ensure the integrity of the storage site and/or to limit potential leaks of $CO_2$ from the storage site, cementing operations may be performed, whereby cement is injected into the annular space to seal the annular space along at least a portion of the length of the wellbore. Different sealing options including zonal isolation and sealing subs (ZISS) are detailed in the concurrently filed application Ser. No. 19/202,192 entitled "SYSTEMS AND METHODS FOR MONITORING STORAGE SITES," which is hereby incorporated by reference in its entirety.

As such, embodiments of the present application are directed towards an improved monitoring system configured to enable sampling without a dedicated monitoring well, reducing installation costs and improving the accuracy of fluid monitoring. For example, a wellbore (e.g., an injection wellbore) may include a casing (e.g., a cement casing) disposed within an open hole. The monitoring system may be disposed between (e.g., radially between) the casing and the open hole, in an annulus, notably outside or "behind" the casing. In some instances, the annulus may be filled with cement or another hardening compound, enclosing at least a portion of the monitoring system in the annulus within the cement. The monitoring system may include a fluid circuit including one or more fluid conduits configured to direct a flow of one or more liquids throughout. The monitoring system may include a perforating device configured to produce one or more perforations during a perforating operation. For example, the perforating device may detonate or fire to produce the one or more perforations extending through a wall of the open hole and into a formation surrounding the wellbore. The perforations may enable fluid flow between the monitoring system and the formation to facilitate sampling (e.g., collection of formation fluid (e.g., first fluid) for analysis) and/or flushing. For example, during a sampling operation, the monitoring system may decrease a pressure of a second fluid (e.g., gas, perforating fluid, flushing fluid, actuation fluid) to a pressure lower than a pressure of the surrounding formation, enabling flow of the first fluid into the monitoring system and further towards a sample collecting system. During a flushing operation of the monitoring system, the monitoring system may increase the pressure of the second fluid, to a pressure higher than the pressure of the surrounding formation, enabling flow of the second fluid through the components of the monitoring system (e.g., filter, perforating device) to clean the components. By disposing at least a portion of the monitoring system within the annulus (e.g., cemented annulus), the monitoring system may non-invasively sample the first fluid from the surrounding formation, without penetrating the casing. In this way, the monitoring device may be deployed in various types of wellbores, such as an injection wellbore, a drilling wellbore, a producing wellbore, a cleaning wellbore, and so forth, without the need for a dedicated wellbore for monitoring.

With the preceding in mind, FIG. 1 is a schematic view of an embodiment of a carbon capture storage system (CCSS) 10 for carbon capture, utilization, and storage (CCUS) operations. The CCSS 10 may include various components configured to enable the storage of carbon dioxide ($CO_2$) in a geological formation 12 (e.g., formation, surrounding formation) of the CCSS 10, which may correspond to a volume of subsurface rock (e.g., subterranean formation) that contains various layers (e.g., rock layers, porous layers, aquifers, impermeable layers). For example, the CCSS 10 may include a wellsite including an injection well 14 (e.g., wellbore) drilled from the surface 16 into and through the geological formation 12 to form an open hole 13 within the geological formation 12, where the injection well 14 intersects the various layers in the subsurface rock of the geological formation 12. In certain embodiments, the injection well 14 may be configured to inject and/or direct undesirable fluid (e.g., carbon dioxide) into one or more of the layers of geological formation 12, thereby enabling the geological formation 12 to effectively store (e.g., permanently store) the undesirable fluid within the subsurface rock of the geological formation 12. Although FIG. 1 relates to a CCSS 10, and more specifically an injection well 14, it will be appreciated embodiments of the present disclosure may be used in other types of wellbores, such as a producing wellbore, a drilling wellbore, a cleaning wellbore, and so forth.

Each of the various layers may include different characteristics that enable the geological formation 12 to effectively store (e.g., permanently store) $CO_2$ introduced into the formation 12 (e.g., via the injection well 14). For example, the geological formation 12 may include an injection layer 18 (e.g., store site, porous layer, receiving layer), one or more sealing layers 20 (e.g., impermeable layers, caprock layers), and one or more additional layers 22. The injection layer 18 may correspond to a portion of the geological formation 12 that is capable of receiving $CO_2$. For example, a permeability and/or porosity of the injection layer 18 may enable $CO_2$ to be injected and contained within the injection layer 18. In certain embodiments, the injection layer 18 may correspond to a deep saline aquifer, a depleted hydrocarbon reservoir, a basalt formation, and the like. In certain embodiments, the injection layer 18 may include one or more fractures (e.g., hydraulic fractures, natural fractures), fissures, and/or faults that enable the injection layer 18 to receive and store the $CO_2$. That is, the injection layer 18 and/or features thereof may define a reservoir 19 (e.g., $CO_2$ reservoir) configured to store $CO_2$ injected into the injection layer 18. The one or more sealing layers 20 may be positioned above and/or below (e.g., directly above, directly below, may overlay) the injection layer 18, thereby sealing the injection layer 18 (e.g., blocking $CO_2$ from traversing through the geological formation 12 into the sealing layer(s) 20 and/or the additional layers 22). For example, the one or more sealing layers 20 may include subsurface rock that has less than a threshold porosity and/or is impermeable, such that fluid (e.g., $CO_2$) is blocked from traversing through the sealing layer(s) 20. Thus, the one or more sealing layers 20 may be configured to limit the $CO_2$ injected into the injection layer 18 from reaching the one or more additional layers 22 and/or the atmosphere.

In the illustrated embodiment, the wellbore of the injection well 14 is completed with a casing 30 (e.g., cemented casing). For example, the casing 30 may extend along the injection well 14, such that the outer diameter of the casing 30 and the open hole 13 collectively define an annulus 15 through which cement may be pumped to seal the open hole 13 and the injection well 14. The cement may be configured to block carbon dioxide from traversing along the annulus 15 into the layers 20, 22 surrounding the injection layer 18 and/or into the atmosphere. That is, the cement may be pumped into the annulus 15 and may be configured to bond with the outer diameter of the casing 30 and with the open hole 13 (e.g., a wall of the open hole), such that the cement occupies the annulus 15, thereby limiting fluid flow (e.g., $CO_2$) through the annulus 15. In certain embodiments, the casing 30 and/or cement within the annulus 15 may be perforated at least in an interval 24 that intersects and/or aligns with the injection layer 18, thereby enabling $CO_2$ to be pumped and/or injected into the reservoir 19 of the injection layer 18. For example, in certain embodiments, a downhole tool 50 may be deployed into the injection well 14 and the downhole tool 50 may be located at a position corresponding to the intersection of the injection layer 18 with the injection well 14. Upon locating the downhole tool 50 within the interval 24, the downhole tool 50 may be operated to inject carbon dioxide through the perforations extending through the casing 30 and cement and into the reservoir 19 of the injection layer 18.

As noted above, it may be desirable to monitor or sample the geological formation 12 to assess the integrity of the storage site (e.g., integrity of the injection layer 18, integrity of the reservoir 19) and/or to identify potential leaks of $CO_2$ into the various layers of the geological formation 12. To this end, the CCSS 10 may include a monitoring system 40 (e.g., sampling system) configured to sample or monitor a first fluid 39 (e.g., formation fluid, water, geological fluid, oil, brine, mud slush, etc.) from within the formation 12 (e.g., one or more layers 20, 22 and/or the injection layer 18). In certain embodiments, at least a portion of the monitoring system 40 may be integrated, incorporated, and/or retained within the annulus 15 (e.g., within the cemented portion between the open hole 13 and the casing 30), thereby enabling monitoring and sampling of the first fluid 39 without penetrating or perforating the casing 30. In other words, the monitoring system 40 may monitor or sample the first fluid 39 from the geological formation 12 in a non-invasive manner, reducing costs (e.g., perforating costs, replacement costs) associated with the CCSS 10. To do so, the monitoring system 40 may be positioned within the annulus 15 prior to cementing of the space between the casing 30 and the open hole 13.

In certain embodiments, the monitoring system 40 may be configured to penetrate (e.g., perforate) the annulus 15 (e.g., the cement of the annulus 15) and/or the formation 12 (e.g., the surrounding layer (e.g., layer 22)) to facilitate flow of the first fluid 39 from the formation 12 to the monitoring system 40. To this end, the monitoring system 40 may include a perforating device 42 (e.g., penetrating device) configured to penetrate or perforate the cement within the annulus and/or the formation 12. In an embodiment, the perforating device 42 may perforate or penetrate the cement of the annulus 15 and/or the formation 12 in response to receiving a second fluid (e.g., gas) supplied from an up hole location, such as a fluid supply 44 (e.g., gas supply). For example, the second fluid may include an inert gas (e.g., Nitrogen gas ($N_2$), Carbon Dioxide ($CO_2$). Helium (He), Argon (Ar), other noble gases). To this end, a fluid circuit 45 including a first conduit 46 (e.g., first fluid conduit) may be fluidly coupled to the perforating device 42 and configured to supply the second fluid to the perforating device 42. Once perforated, the first fluid 39 may flow into the monitoring system 40 to be sampled or monitored. For example, the first fluid 39 may enter the monitoring system 40 through the perforating device 42, and may be directed up hole to a sample collecting system 48 via a second conduit 52 (e.g., second fluid conduit) of the fluid circuit 45.

Although a single perforating device 42 is illustrated in the embodiment of FIG. 1, it will be appreciated the monitoring system 40 may include multiple (e.g., more than one) perforating devices 42 along the length of the open hole 13. For example, an additional perforating device 42 may be positioned above (e.g., up hole), below (e.g., downhole), and/or adjacent to the illustrated perforating device 42 to sample or collect fluid from alternative locations within the formation 12, such as at the sealing layer 20, at the injection layer 18, or at another layer 22.

The sample collecting system 48 may receive the first fluid 39 to determine one or more characteristics or properties of the first fluid 39, such as a concentration of gas (e.g., $CO_2$) within the first fluid 39. In an embodiment, based on the determined one or more characteristics or properties of the first fluid 39 (e.g., determined by the sample collecting system 48), the monitoring system 40 of the CCSS 10 may alter or adjust one or more components of the CCSS 10. For example, the sample collecting system 48 may include one or more sensors and/or analyzers to measure a density, a viscosity, a fluid composition, a pH level, or any combination thereof. In some embodiments, the measurements of the fluid composition may include a content of any leaked storage fluid in the first fluid 39, wherein the leaked storage fluid may include the $CO_2$. In some embodiments, the sample collecting system 48 may obtain measurements in combination with in situ measurements acquired by the monitoring system 40 near the perforations generated by the perforating device 42, or the sample collecting system 48 may operate alone without any in situ measurements.

Present embodiments may be directed toward monitoring systems 40 that incorporate monitoring lines (e.g., fiber optic, electric, and/or optical telemetry cables, monitoring cables, other monitoring lines) along a length of an injection wellbore to monitor and verify the integrity of a storage site fluidly coupled to the injection wellbore. Monitoring systems 40 may be installed and/or configured in a manner that provides substantially improved or optimal cementing conditions, thereby limiting and/or blocking a tendency of $CO_2$ to leak through an annular space between a casing of the injection wellbore and the open hole. For example, the monitoring systems 40 discussed herein may include various components and/or features that enable the monitoring lines to be at least partially integrated with and/or incorporated into the borehole casing of an injection well, thereby providing substantially improved or optimal conditions for cementing operations. That is, the monitoring systems 40 discussed herein may include one or more sections that at least partially incorporate and/or integrate the monitoring line(s) with the borehole casing, thereby providing increased space between the outer diameter of the borehole casing and the open hole (e.g., geological formation) and/or providing surfaces (e.g., smooth surfaces, surfaces flush with the borehole casing) that facilitate cementing operations. In some embodiments, the one or more sections that at least partially incorporate and/or integrate the monitoring line(s) with the borehole casing 30 provide unobstructed lengths that facilitate cementing operations. That is, the cement may fill the space between the outer diameter of the borehole casing 30 and the open hole 13 for a mandrel length without interference of any monitoring lines to the cementing operation. The increased space and/or the surfaces (e.g., smooth surfaces) provided by integrating the monitoring line with the borehole casing 30 may improve cementing conditions, thereby improving the efficiency and/or efficacy of a cementing operation. As a result, the integrity of the storage site is improved and the likelihood of potential $CO_2$ leakage is reduced. In certain embodiments, the borehole casing 30 may be designed and/or configured such that the one or more sections that include the monitoring lines integrated with the borehole casing align with the one or more sealing layers 20 of the geological formation. For example, it may be particularly beneficial to provide substantially improved or optimal cementing conditions along the injection well at positions corresponding to the one or more sealing layers 20 to ensure the integrity of the storage site.

The monitoring system may include one or more monitoring lines (e.g., fiber optic lines, electrical and/or optical telemetry cables, tubing-encased fiber optic line [TEF], tubing-encased cable [TEC], monitoring cable, other monitoring lines) that extend along an outer diameter of the casing 30 (e.g., extend along and through the annular space 15 defined by the casing 30 and the open hole 13). The one or more monitoring lines may monitor temperature, acoustics, electromagnetic radiation, pressure, among other properties of the geological formation. A monitoring line across a sealing layer 20 (e.g., caprock) may monitor properties of the sealing layer. The one or more monitoring lines may be configured to monitor the geological formation 12 for the presence of $CO_2$ within the annular space 15 and/or within the sealing layers 20 and/or additional layers 22 of the geological formation 12. For example, the monitoring system may be configured to monitor the well bore at strategic locations, such as in formations with potable water, above sealing layers 20, within an injection layer 18, above or near faults or fractures of the sealing layers 20 and injection layers 18, or any combination thereof.

To this end, the monitoring system 40 may include a controller 53 (e.g., control system control panel, control circuitry, automation controller, programmable controller) that is communicatively coupled to one or more components of the monitoring system 40 (e.g., check valves, gauges, timing devices, perforating device 42, fluid supply 44) and is configured to monitor, adjust, and/or otherwise control operation of one or more components of the monitoring system 40. For example, one or more control transfer devices, such as wires, cables, wireless communication devices, and the like, may communicatively couple the components of the monitoring system 40 to the controller 53. That is, the components of the monitoring system 40 may each have one or more communication components that facilitate wired or wireless (e.g., via a network) communication with the controller 53. In some embodiments, the communication components may include a network interface that enables the components of the monitoring system 40 to communicate via various protocols such as EtherNet/IP, ControlNet, DeviceNet, or any other communication network protocol. Alternatively, the communication components may enable the components of the monitoring system 40 to communicate via mobile telecommunications technology, Bluetooth®, near-field communications technology, and the like. As such, the components of the monitoring system 40 may wirelessly communicate data between each other. In other embodiments, operational control of certain components of the monitoring system 40 may be regulated by one or more relays or switches (e.g., a 24 volt alternating current [VAC] relay).

The controller 53 may include processing circuitry 55 (e.g., processor), such as a microprocessor, which may execute software for controlling the components of the monitoring system 40. The processing circuitry 55 may include multiple microprocessors, one or more "general-purpose" microprocessors, one or more special-purpose microprocessors, and/or one or more application specific integrated circuits (ASICS), or some combination thereof. For example, the processing circuitry 55 may include one or more reduced instruction set (RISC) processors.

The controller 53 may also include a memory device 57 (e.g., a memory) that may store information, such as instructions, executable code, control software, look up tables, configuration data, other data, or any combination thereof. The memory device 57 may include a volatile memory, such as random access memory (RAM), and/or a nonvolatile memory, such as read-only memory (ROM). The memory device 57 may store a variety of information and may be used for various purposes. For example, the memory device 57 may store processor-executable instructions including firmware or software for the processing circuitry 55 to execute, such as instructions for controlling components of the monitoring system 40 (e.g., check valves). The memory device 57 may also store data relating to operating parameters of the monitoring system 40 (e.g., measured parameters, set points, etc.). In some embodiments, the memory device 57 is a tangible, non-transitory, machine-readable-medium that may store machine-readable instructions for the processing circuitry 55 to execute. The memory device 57 may include ROM, flash memory, a hard drive, or any other suitable optical, magnetic, or solid-state storage medium, or a combination thereof.

Figure 2:
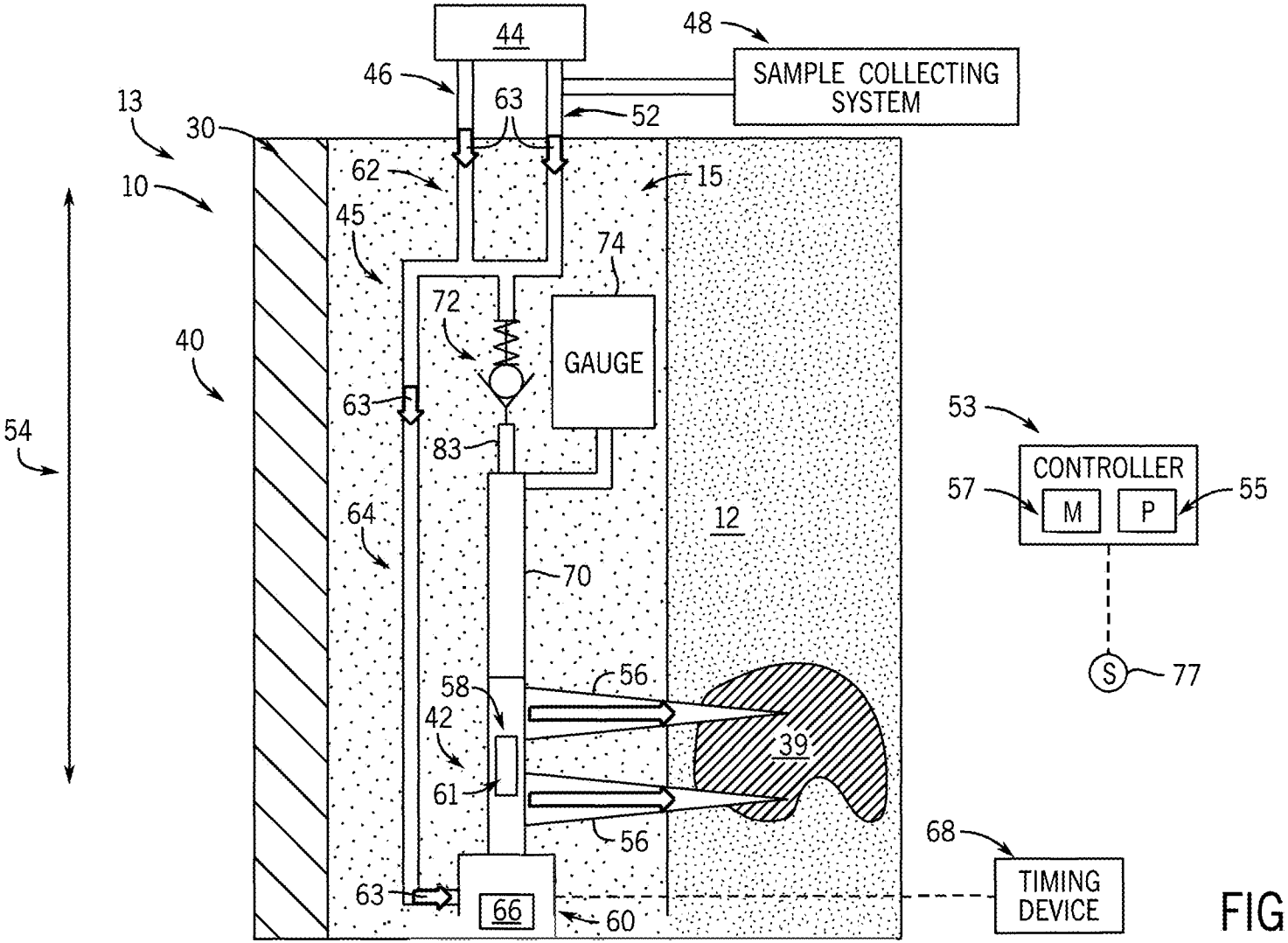
FIG. 2 is a schematic illustration of an embodiment of the monitoring system, in accordance with an aspect of the present disclosure.

FIG. 2 illustrates an embodiment of the monitoring system 40 in a downhole location of the CCSS 10. As discussed below, FIG. 2 illustrates actuation of the perforating device 42 prior to fluid sampling by the monitoring system 40. As discussed above, at least a portion of the monitoring system 40 may be positioned within the annulus 15 between the casing 30 and a wall of the open hole 13. In an embodiment, the annulus 15 may be filled with cement, securing the portion of the monitoring system 40 at an axial location of the open hole 13, relative to an axis 54 extending along the length of the open hole 13. However, in alternate embodiments, the portion of the monitoring system 40 may be secured within the annulus 15 via other suitable devices, such as packing positioned downhole and/or up hole of the portion of the monitoring system 40, relative to the axis 54.

The monitoring system 40 may include the perforating device 42 configured to penetrate or perforate the cement of the annulus 15 and/or the surrounding formation 12. That is, the perforating device 42 may produce one or more perforations 56 extending from the perforating device 42 towards the formation 12 (e.g., through the wall of the open hole 13) to enable fluid flow between the formation 12 and the annulus 15, and more specifically the monitoring system 40 within the annulus 15. In an embodiment, the perforating device 42 may include a perforating gun 58 and an initiation device 60 (e.g., firing head, ignition head, detonation head, charge activator, fire control unit, etc.). The perforating gun 58 may generally include a body (e.g., cylindrical body) configured to withstand high pressure and one or more perforating holes configured to discharge energy to create or produce the perforations 56. The perforating gun 58 may include a perforating mechanism 61 configured to discharge energy in the form of a high pressure fluid, a controlled explosion, a high energy projectile, or another suitable form. The number and size (e.g., diameter) of the perforating holes may be based on a desired size of the perforations 56, downhole conditions, one or more parameters of the first fluid 39, one or more parameters of the formation 12 conditions, and/or another suitable parameter.

The initiation device 60 may be coupled (e.g., fluidly coupled) to the perforating gun 58 and configured to activate (e.g., trigger) the perforating gun 58. For example, the initiation device 60 may be configured to activate the perforating mechanism 61 of the perforating gun 58. In certain embodiments, the initiation device 60 may activate the perforating mechanism 61 of the perforating gun 58 hydraulically, or in other words, in response to a pressure within the initiation device 60 reaching a threshold pressure (e.g., initiation pressure) and/or in response to a pressure signal, such as one or more pressure pulsations. To this end, the initiation device 60 may be fluidly coupled to the fluid supply 44 via the first conduit 46 and/or the second conduit 52. The first conduit 46 and the second conduit 52 may collectively define a U-tube 62 of the monitoring system 40. Specifically, the initiation device 60 may be fluidly coupled to the U-tube 62 (e.g., the first conduit 46 and/or the second conduit 52) via a third conduit 64 (e.g., third fluid conduit, actuation conduit) of the fluid circuit 45. In a perforating operation, the third conduit 64 may direct the second fluid (e.g., the second fluid at a relatively high pressure) from the U-tube 62 to the initiation device 60 to activate or detonate the perforating gun 58 to produce perforations 56. For instance, during the perforating operation of the monitoring system 40, the controller 53 may instruct the fluid supply 44 to supply a fluid flow and/or fluid pressure in a downward direction as indicated by the downward arrows 63 in the first, second, and third conduits 46, 52, and 64, such that fluid is directed toward the perforating device 42. For example, the controller 53 may instruct the fluid supply 44 to increase the pressure of the second fluid above a threshold pressure along the third conduit 64, directing the second fluid to the initiation device 60 to activate the perforating mechanism 61 of the perforating gun 58. In some embodiments, the controller 53 may instruct the fluid supply 44 to provide a pressure signal (e.g., a pressure pulse, pattern, or the like) to the initiation device 60 to activate the perforating mechanism 61 of the perforating gun 58. For example, the pressure signal may include a pressure pulse including 1, 2, 3, 4, 5, or more pressure pulses, a pressure pattern or profile of pressure over time, or any combination thereof.

Additionally or alternatively, the initiation device 60 may activate the perforating gun 58 via an activation signal, such as an electrical, data, and/or control signal. For example, the initiation device 60 may be communicatively coupled to the controller 53 of the monitoring system 40, where in response to receiving a signal (e.g., electrical signal) from the controller 53, the initiation device 60 may activate the perforating mechanism 61 of the perforating device 42 to produce the perforations 56. For instance, the initiation device 60 may include a communication module, where in response to receiving a signal (e.g., wireless signal) from the controller 53, the initiation device 60 may activate the perforating mechanism 61 of the perforating gun 58 to produce the perforations 56. To this end, the initiation device 60 may include a power source 66 (e.g., downhole power source, up hole power source), where upon receiving the signal from the controller 53 (e.g., the communication module of the initiation device 60 receiving the signal from the controller 53), the power source 66 may activate the perforating mechanism 61 of the perforating device 42 to produce the perforations 56.

In some embodiments, the initiation device 60 may activate the perforating gun 58 via an actuator, such as a mechanical actuator. For example, the initiation device 60 may activate the perforating mechanism 61 of the perforating device 42 by physical motion (e.g., vibration, stabbing, shock), pressure, or mechanical motion. In some instances, the initiation device 60 may be spring loaded, and may activate the perforating mechanism 61 of the perforating device 42 in response to time, pressure, depth (e.g., depth of the perforating gun 58), and/or another suitable parameter. As such, the initiation device 60 may include or may be coupled to a timing device 68 configured to activate the initiation device 60 to activate the perforating mechanism 61 of the perforating device 42 at preset or predetermined intervals. In some embodiments, the timing device 68 may be included in other embodiments of the initiation device 60, such as embodiments employing hydraulic and/or electric initiating mechanisms.

In the illustrated embodiment, during operation of the perforating device 42, the second fluid (e.g., relatively high pressure fluid (e.g., $N_2$ (Nitrogen gas))) may be directed from the fluid supply 44 through the U-tube 62 and towards the initiation device 60 via the third conduit 64. Upon receiving the second fluid, the initiation device 60 may activate the perforating mechanism 61 to cause the perforating gun 58 to produce the perforations 56. The perforations 56 through the cemented annulus 15 and/or the formation 12 may enable flow of the first fluid 39 from the surrounding formation 12 into the monitoring system 40, facilitating sampling by the sample collecting system 48. For example, as discussed in further detail below, the first fluid 39 may flow through a fluid circuit 75 or fluid flow path 69 extending through the perforating gun 58, a filter 70, a first check valve 72, and one or more of the conduits 46 and 52 of the U-tube 62 to the sample collecting system 48. The monitoring system 40 may include one or more sensors and/or gauges, such as a gauge 74, along the fluid flow path 69. For example, the gauge 74 may be configured to measure temperature, pressure, flow rate, or any combination thereof. In some embodiment, the one or more sensors and/or gauges (e.g., gauge 74) may be configured to monitor a density, a viscosity, a fluid composition, a pH level, or any combination thereof. In some embodiments, the measurements by the one or more sensors and/or gauges (e.g., gauge 74) may trigger a sampling operation by the monitoring system 40. For example, the measurements may be compared to a baseline, and any deviations from the baseline may indicate a possible leak of the stored fluids (e.g., $CO_2$).

Figure 3:
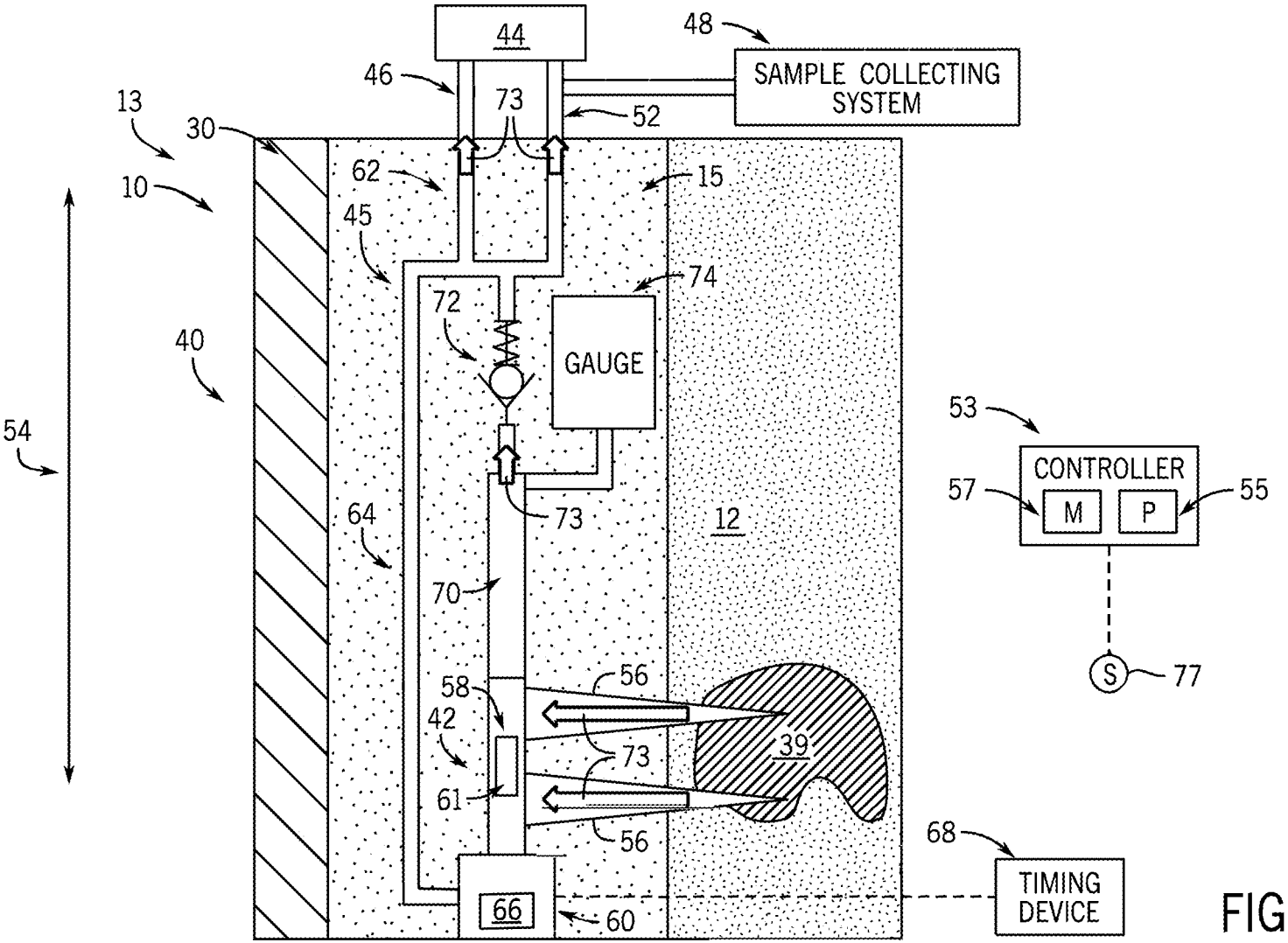
FIG. 3 is a schematic illustration of an embodiment of the monitoring system, in accordance with an aspect of the present disclosure.

To further illustrate, FIG. 3 depicts an embodiment of a portion of the monitoring system 40 during a sampling operation of the surrounding formation 12. In certain embodiments, the sampling operation may be performed at predefined time intervals (e.g., daily, weekly, monthly, etc.), in response to user input or requests, in response to sensor feedback (e.g., gauge 74), in response to predictions by machine learning/artificial intelligence models, or any combination thereof. FIG. 3 illustrates similar elements to that of FIG. 2, with the exception of one or more flows paths of the first fluid 39, illustrated by the arrows 73. During the sampling operation, the pressure within the monitoring system 40 (e.g., second fluid pressure within the perforating device 42 and/or conduits 46, 52, 64, etc.) may be relatively lower than a pressure of the formation 12. For example, the fluid supply 44 may be adjusted (e.g., via the controller 53) to decrease the second fluid pressure directed into the monitoring system 40 via the U-tube 62. The pressure differential between the monitoring system 40 and the formation 12 may enable flow of the first fluid 39 into the monitoring system 40, such as through holes within the perforating gun 58. The pressure differential in the monitoring system 40 may enable fluid flow from a downhole location (e.g., the perforating device 42) to an up hole or surface location (e.g., the sample collecting system 48), such as via a sampling conduit 83 of the fluid circuit 75.

In some embodiments, the monitoring system 40 may include the filter 70 configured to filter the first fluid 39 prior to flow into the sample collecting system 48. For example, the first fluid 39 may flow into the filter 70 upon entering the monitoring system 40 (e.g., after flowing into the perforating gun 58). As such, during the sampling operation (e.g., when the first fluid 39 is flowing into the monitoring system 40 from the formation 12), the filter 70 may be downstream of the perforating gun 58. The filter 70 may be configured to remove solid particles, debris, and other containments from the first fluid 39 before the first fluid 39 is directed towards (e.g., via the sampling conduit 83) the surface (e.g., surface 16) for analysis via the sample collecting system 48. The filter 70 may include a housing configured to withstand high pressures, one or more inlets, one or more outlets, and a filter element. In some embodiments, the filter element may include mesh material, synthetic material, composite material, or another filtering material configured to filter the first fluid 39. By filtering the first fluid 39 before flowing to a surface location, the monitoring system 40 may experience reduced blockage due to undesirable particles, increasing the life of the monitoring system 40. Additionally, by filtering the first fluid 39, the sample collecting system 48 may detect a composition of the first fluid 39 with increased accuracy.

In some embodiments, the monitoring system 40 may include the first check valve 72 (e.g., first one-way valve, first electronic valve) configured to regulate fluid flow in the monitoring system 40. For example, the first check valve 72 may be positioned between the filter 70 and the U-tube 62 (e.g., along a fluid conduit extending between the filter 70 and the U-tube 62) on the sampling conduit 83, and configured to enable flow of fluid (e.g., flow of the first fluid 39 and/or the second fluid) in one direction (e.g., up hole relative to the axis 54) while substantially blocking fluid flow in a second direction (e.g., downhole relative to the axis 54). In this way, fluid may not inadvertently flow from the fluid supply 44 through the filter 70 during the perforating operation of the monitoring system 40, and the second fluid may instead flow towards the initiation device 60 via the third conduit 64. In some embodiments, the first check valve 72 may be a swing check valve, a ball check valve, a lift check valve, a diaphragm check valve, and so forth. The first check valve 72 may open and close in response to a pressure differential and/or an actuator, such as an electrical actuator, a fluid actuator, or a combination thereof. In some embodiments, the actuator of the first check valve 72 may be communicatively coupled to the controller 53, where the controller 53 may regulate operation of the first check valve 72 based on an operating mode of the monitoring system 40 (e.g., perforating operation, sampling operation, flushing operation) and/or override the first check valve 72 based on certain conditions.

In an embodiment, the monitoring system 40 may include the gauge 74 (e.g., pressure gauge, temperature gauge) configured to measure or detect a pressure and/or temperature (e.g., a pressure and/or temperature of the first fluid 39, the second fluid, or a mixture) within the monitoring system 40. In an embodiment, based on the detected pressure and/or temperature (e.g., a change or deviation of the temperature and/or pressure of fluid within the monitoring system 40), the controller 53 may adjust, actuate, or otherwise operate a component of the monitoring system 40. For example, based on a detected pressure and/or temperature of fluid within the monitoring system 40, the controller 53 may instruct the sample collecting system 48 to begin or stop sampling of fluid (e.g., the first fluid 39). In some embodiments, the gauge 74 may be fluidly coupled to the monitoring system 40 to detect the pressure and/or temperature of fluid circulating therethrough. In the illustrated embodiment, the gauge 74 is fluidly coupled to the fluid circuit 75 via the filter 70, however, other locations are contemplated.

In an embodiment, the monitoring system 40 may include the sensor 77 (e.g., downhole sensor) configured to measure or detect a property (e.g., a density, a viscosity, a fluid composition, a pH level, or any combination thereof) or parameter of one or more fluids (e.g., deposited $CO_2$, first fluid 39, second fluid) associated with the monitoring system 40. For example, the sensor 77 may be positioned downhole, such as near the reservoir 19, and configured to monitor $CO_2$ composition (e.g., $CO_2$ composition within the surrounding formation 12, $CO_2$ in the first liquid 39.) In an embodiment, based on the detected property of the fluids (e.g., $CO_2$ composition, downhole $CO_2$ composition), the controller 53 may adjust, actuate, or otherwise operate a component of the monitoring system 40. For example, based on $CO_2$ composition in the surrounding formation 12 and/or in the monitoring system 40, the controller 53 may instruct the sample collecting system 48 to begin or stop sampling of fluid (e.g., the first fluid 39) for further analysis. In an embodiment, the sensor 77 may be fluidly coupled to the fluid circuit 75.

Figure 4:
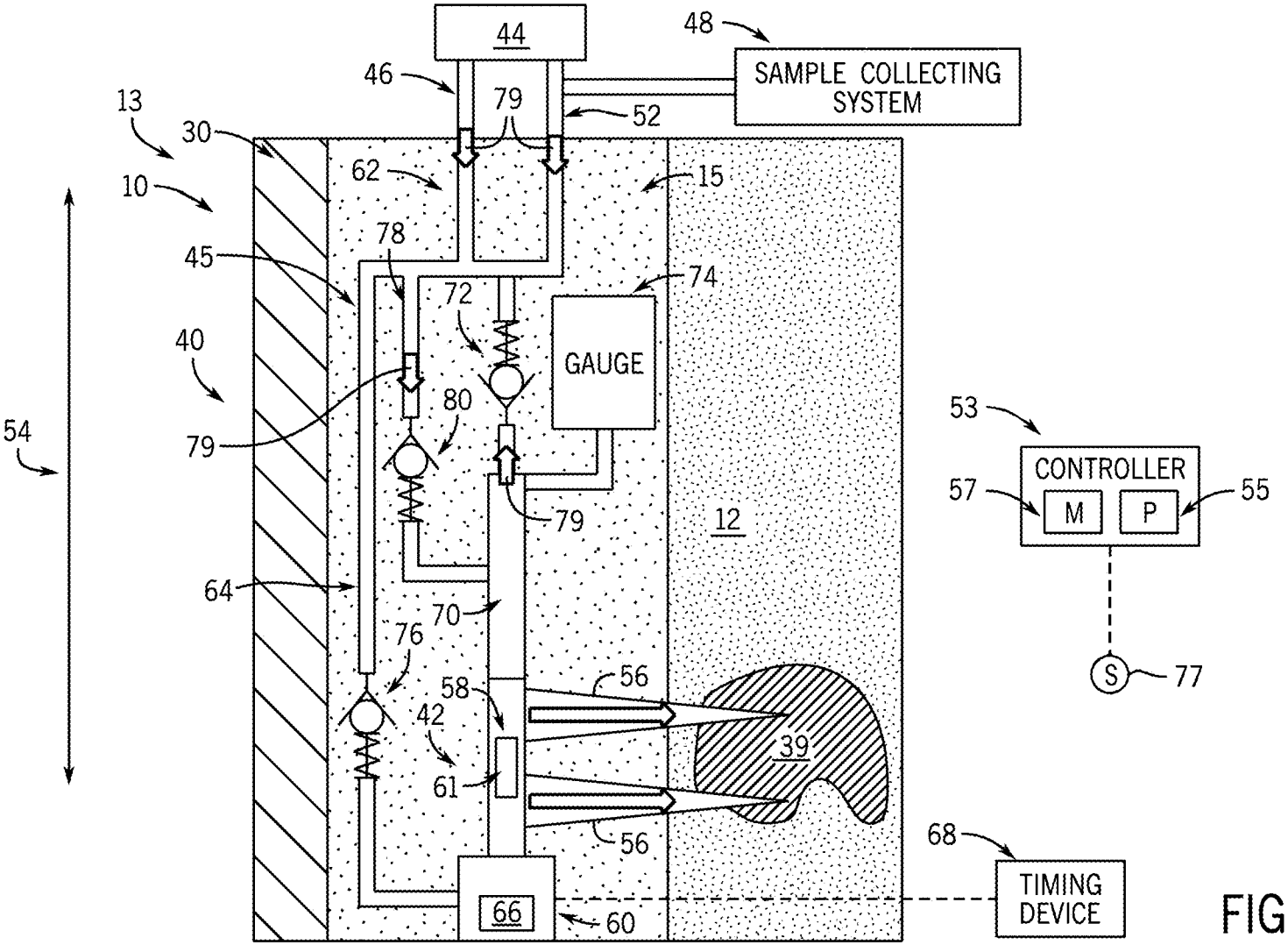
FIG. 4 is a schematic illustration of an embodiment of the monitoring system, in accordance with an aspect of the present disclosure.

FIG. 4 illustrates an embodiment of the monitoring system 40 during the perforating operation. FIG. 4 illustrates similar elements to those of FIGS. 2 and 3, with the exception of a second check valve 76 (e.g., second one way valve, second electronic valve), a fourth conduit 78 (e.g., fourth fluid conduit, flush conduit) of the fluid circuit 45, and a third check valve 80 (e.g., third one way valve, third electronic valve). The second check valve 76 may be disposed along the third conduit 64 between the U-tube 62 and the perforating device 42 (e.g., initiation device 60) and configured to enable flow of fluid (e.g., flow of the second fluid) in one direction (e.g., towards the perforating device 42, downhole relative to the axis 54) upon a fluid pressure overcoming a threshold pressure, while substantially blocking fluid flow in a second direction (e.g., towards the U-tube 62, up hole relative to the axis 54). In this way, fluid may not inadvertently flow to the U-tube 62 from the initiation device 60 via the third conduit 64 during operation of the perforating device 42. In the perforating operation, the controller 53 operates the fluid supply 44 to supply the flow of fluid, indicated by the arrows 79, at the fluid pressure above the threshold pressure to open the second check valve 76, thereby delivering the flow of fluid to the initiation device 60 to operate the perforating gun 58. In certain embodiments, the threshold pressure may be based on a mechanical design (e.g., spring force) of the second check valve 76. In some embodiments, the second check valve 76 may be a swing check valve, a ball check valve, a lift check valve, a diaphragm check valve, and so forth. In some embodiments, an actuator (e.g., electrical and/or fluid actuator) of the second check valve 76 may be communicatively coupled to the controller 53, where the controller 53 may regulate operation of the second check valve 76 based on an operating mode of the monitoring system 40.

Figure 5:
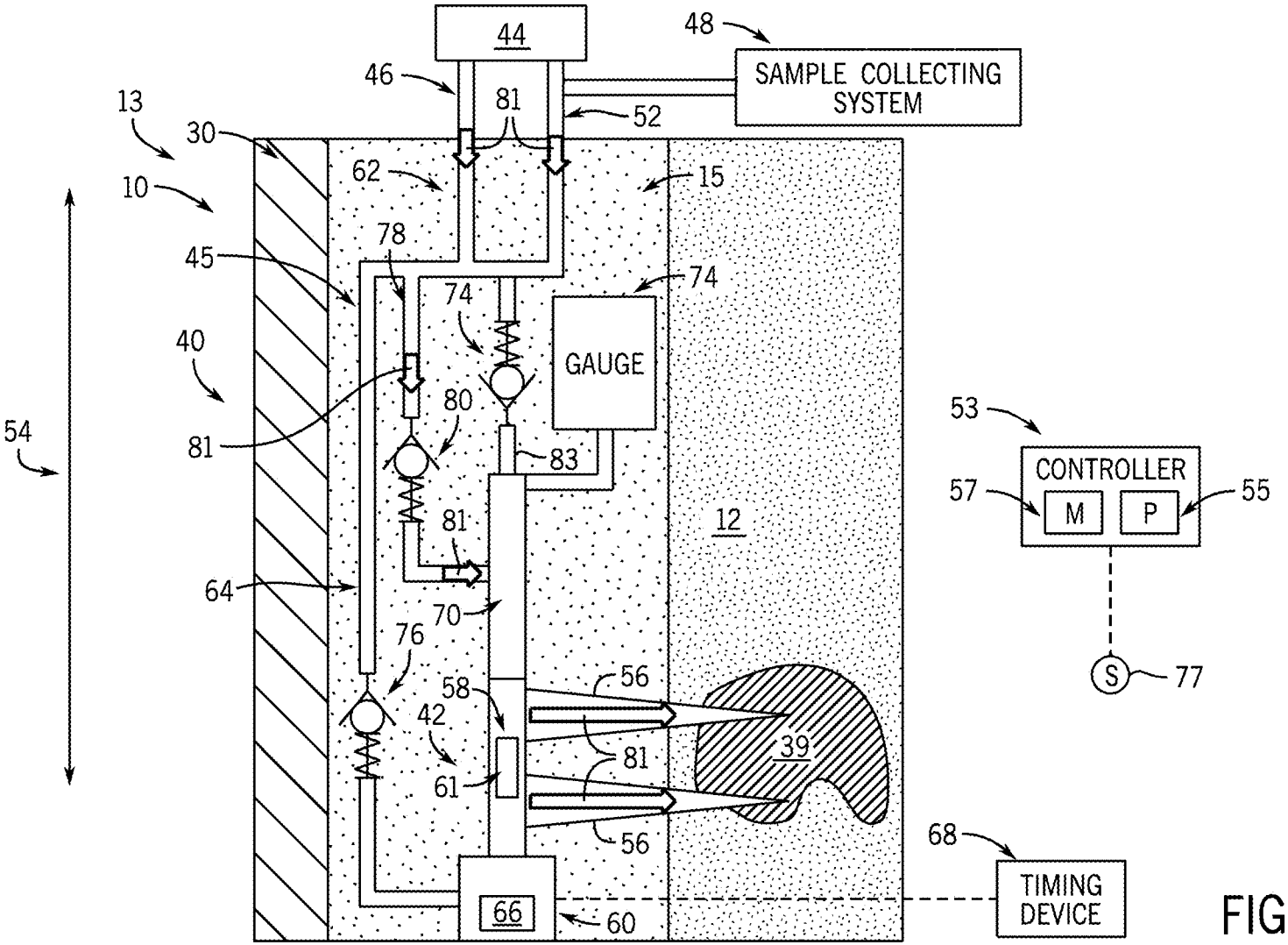
FIG. 5 is a schematic illustration of an embodiment of the monitoring system, in accordance with an aspect of the present disclosure.

In some embodiments, the monitoring system 40 may be operated in a flushing operation, where the monitoring system 40 is configured to flush or clean the filter 70 and/or other components of the monitoring system 40. To this end, the monitoring system 40 may include the fourth conduit 78 configured to direct fluid (e.g., the second fluid) from an up hole location (e.g., the U-tube 62, the fluid supply 44) and through the filter 70. For example, FIG. 5 illustrates an embodiment of the monitoring system 40 during the flushing operation, wherein the arrows 81 depict a direction of flow of the second fluid through the monitoring system 40. FIG. 5 illustrates similar elements to that of FIG. 4, with the exception of differing flow directions of fluid through the monitoring system 40, depicted by the use of arrows 81. For example, during the flushing operation, the second fluid may be directed from the U-tube 62, into the fourth conduit 78, and through the filter 70 to flush out containments, improving filtering of the first fluid 39 during the sampling operation and increasing the life of the filter 70. In doing so, the controller 53 may instruct the fluid supply 44 to increase a pressure (e.g., increase a pressure past a threshold pressure) and/or flow rate of the second fluid into the monitoring system 40 (e.g., via the U-tube 62) to enable flow of the second fluid in a generally downhole direction, relative to the axis 54. During the flushing operation, fluid (e.g., the first fluid 39, the second fluid, a mixture) of the monitoring system 40 may be further expelled or discharged from the perforating device 42 (e.g., the perforating gun 58) and further through the perforations 56 into the surrounding formation 12, discharging undesirable containments away from the monitoring system 40. In some embodiments, during the flushing operation, fluid flow may be substantially blocked (e.g., via the second check valve 76) in the third conduit 64, blocking flow to the initiation device 60.

In an embodiment, the fourth conduit 78 may include the third check valve 80 positioned between the U-tube 62 and the filter 70 and configured to enable flow of second fluid in one direction (e.g., towards filter 70, downhole relative to the axis 54) while substantially blocking fluid flow in a second direction (e.g., towards the U-tube 62, up hole relative to the axis 54). In an embodiment, the third check valve 80 may enable fluid flow upon a pressure of the second fluid reaching or surpassing a threshold pressure. The threshold pressure may be based on one or more parameters of the third check valve 80, such as a mechanical design (e.g., spring force). In some embodiments, the threshold pressure of the third check valve 80 may be different from a threshold pressure of the second check valve 76. For example, threshold pressure of the third check valve 80 may be less than the threshold pressure of the second check valve 76, such that during the flushing operation, the fluid supply 44 may increase the pressure of second fluid to or past the threshold pressure of third check valve 80, but below the threshold pressure of the second check valve 76, thereby enabling flow of the second fluid through the third check valve 80, while substantially blocking flow of the second fluid through the second check valve 76. In some embodiments, the third check valve 80 may be a swing check valve, a ball check valve, a lift check valve, a diaphragm check valve, and so forth. In some embodiments, an actuator (e.g., electrical and/or fluid actuator) of the third check valve 80 may be communicatively coupled to the controller 53, where the controller 53 may regulate operation of the third check valve 80 based on an operating mode of the monitoring system 40.

Figure 6:
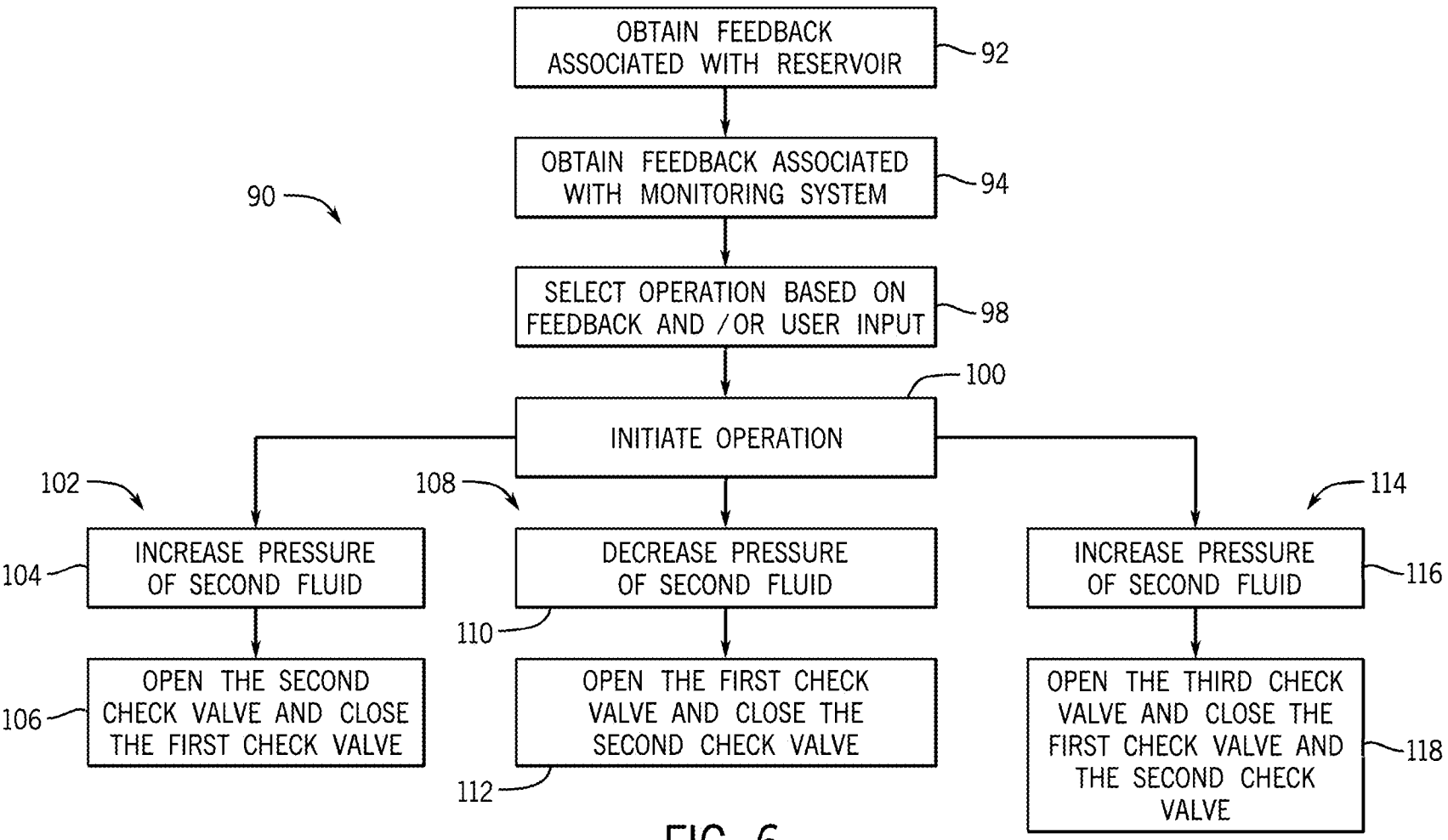
FIG. 6 is a block diagram of an embodiment of a method of operation for the monitoring system, in accordance with an aspect of the present disclosure.

With the foregoing in mind, FIG. 6 is a method 90 of operating the monitoring system 40, in accordance with aspects of the present disclosure. As will be appreciated, one or more steps (e.g., control sequences) of the method 90 may be performed by the controller 53. For example, computer executable instructions or code for performing the one or more control sequences and/or other portions of the method 90 may be stored on the memory device 57, and the processing circuitry 55 may execute the instructions to perform the one or more control sequences of the method 90. In some embodiments, one or more steps of the method 90 may be performed by another controller of the monitoring system 40. In additional or alternative embodiments, multiple components or systems may perform one or more steps of the method 90. It should also be noted that additional steps may be performed with respect to the illustrated method 90 and control sequences thereof. Moreover, certain steps of the method 90 may be removed, modified, and/or performed in a different order. In some embodiments, certain steps of the method 90 may not be performed. Further still, one or more of the steps of the method 90 described herein may be performed in any suitable relation with one another, such as in response to one another and/or in parallel with one another. The method 90 is discussed with respect to element numbering illustrated in FIGS. 1-5 and discussed above.

At block 92, the controller 53 may receive feedback (e.g., sensor feedback, gauge feedback) associated with the reservoir 19. For example, the controller 53 may receive feedback from the gauge 74 indicative of a pressure and/or temperature of the fluid (e.g., $CO_2$) associated with the reservoir 19. Additionally or alternatively, the controller 53 may receive feedback from the sensor 77 indicative of a property (e.g., a density, a viscosity, a fluid composition, a pH level, or any combination thereof) of the fluid associated with the reservoir 19.

At block 94, the controller 53 may receive feedback (e.g., sensor feedback, gauge feedback) associated with the monitoring system 40. For example, the controller 53 may receive feedback from the gauge 74 indicative of a pressure and/or temperature of the fluid (e.g., first fluid 39, second fluid) within the monitoring system 40. Additionally or alternatively, the controller 53 may receive feedback from the sensor 77 indicative of a property (e.g., a density, a viscosity, a fluid composition, a pH level, or any combination thereof) of the fluid within the monitoring system 40.

At block 96, an operation of the monitoring system 40 may be selected based on the feedback and/or user input. For example, based on the feedback received from the gauge 74 and/or the sensor 77, the controller 53 may determine an operating mode of the monitoring system 40, such as a perforating operation 102, a sampling operation 108, or a flushing operation 114. Alternatively, the operating mode of the monitoring system 40 may be selected (e.g., manually selected) by an operator of the CCSS 10. In an embodiment, the operator may be provided with one or more options (e.g., control options) based on the feedback received by the controller 53. For example, the controller 53 may generate one or more options (e.g., suggested options), such as a suggested operating mode, to a graphical user interface (GUI) operated by the operator, where the options are based on the feedback received by the controller 53. The operator may then select the option, such as an operating mode of the monitoring system 40, from the one or more options to initiate the selected operating mode, indicated in block 100.

Upon receiving the selection, the controller 53 may initiate operation of the perforating operation 102, the sampling operation 108, and/or the flushing operation 114, indicated by block 100. During the perforating operation 102, the pressure of the second fluid (e.g., gas, N 2) may be increased, as illustrated in block 104. For example, the controller 53 may instruct the fluid supply 44 to increase the pressure of the second fluid through the U-tube 62, thereby directing the second fluid downhole towards the perforating device 42. In some embodiments, the controller 53 may increase the pressure of the second fluid in preset or predetermined intervals, based on a desired parameter of the perforations 56. Referring now to block 106, during the perforating operation 102, the second check valve 76 may be opened and the first check valve 72 may be closed. In some embodiments the first check valve 72 and/or the second check valve 76 may automatically or passively regulate fluid flow, without electronic actuation. For example, upon the pressure of the second fluid increasing past a pressure threshold, the second check valve 76 may automatically open to enable flow of the second fluid towards the perforating device 42. In some embodiments, the first check valve 72 may remain closed due to the higher pressure differential between the second fluid on a first side (e.g., U-tube 62 side) and the fluid (e.g., second fluid and/or first fluid 39) on a second side (e.g., perforating device 42 side). In some embodiments, the first check valve 72 and/or the second check valve 76 may be actuated (e.g., opened, closed) in response to a signal received from the controller 53. In any case, upon opening the second check valve 76, the second fluid may flow to the initiation device 60 to activate the perforating device 42 (e.g., the perforating gun 58) to produce the perforations 56.

During the sampling operation 108, the pressure of the second fluid may be decreased, as illustrated in block 110. For example, the controller 53 may instruct the fluid supply 44 to decrease the pressure of the second fluid in or through the U-tube 62, thereby enabling fluid (e.g., the second fluid) to be directed up hole (e.g., from the perforating device 42 to the sample collecting system 48). Referring now to block 112, during the sampling operation 108, the first check valve 72 may be opened and the second check valve 76 may be closed. In some embodiments, the first check valve 72 and/or the second check valve 76 may automatically or passively regulate fluid flow, without electronic actuation. For example, upon the pressure of the fluid (e.g., first fluid 39, second fluid, mixture of first and second fluid) increasing past a pressure threshold, the first check valve 72 may automatically open to enable flow of fluid towards the U-tube 62 and/or up hole. In some embodiments, the second check valve 76 may remain closed due to the mechanical design (e.g., spring force) of the second check valve 76. In some embodiments, the first check valve 72 and/or the second check valve 76 may be actuated (e.g., opened, closed) in response to a signal received from the controller 53.

During the flushing operation 114, the pressure of the second fluid (e.g., gas) may be increased, as illustrated in block 116. For example, the controller 53 may instruct the fluid supply 44 to increase the pressure of the second fluid through the U-tube 62, thereby directing the second fluid downhole towards the filter 70. Referring now to block 118, during the flushing operation 114, the third check valve 80 may be opened and the first check valve 72 and the second check valve 76 may each be closed. In some embodiments, the first check valve 72, the second check valve 76, and/or the third check valve 80 may automatically or passively regulate fluid flow, without electronic actuation. For example, upon the pressure of the second fluid increasing past a pressure threshold, the third check valve 80 may automatically open to enable flow of the second fluid through the filter 70 (e.g., the fourth conduit 78) and out of the monitoring system 40 via the perforations 56. In some embodiments, the first check valve 72 and the second check valve 76 may remain closed due to the mechanical design (e.g., spring force) of the check valves and/or a pressure differential. In some embodiments, the first check valve 72, the second check valve 76, and/or the third check valve 80 may be actuated (e.g., opened, closed) in response to a signal received from the controller 53. In any case, upon opening the third check valve 80, the second fluid may flow through the filter 70 to flush or clean the filter 70 of containments collected during the sampling operation 108.

Technical effects of the disclosed embodiments enable non-invasive monitoring of a first fluid 39 from a geological formation 12 without penetrating or perforating the casing 30. The monitoring system 40 described in detail above includes a perforating gun 58, a U-tube 62, a filter 70, one or more gauges 74, and one or more check valves (e.g., 72, 76, 80), configured to enabling sampling of the first fluid 39 via a sample collecting system 48. The monitoring system 40 is generally outside of the casing 30, and enables collection of a sample of the first fluid 39 to analyze the integrity of the fluid storage (e.g., $CO_2$ storage) in the geological formation 12. The gauges 74 may be used to monitor various properties of the first fluid 39, and also may be used to trigger operation of the monitoring system 40 to obtain a sample for further processing at the sample collecting system 48. The U-tube 62 is useful in forcing a flow of the sample (e.g., first fluid 39) from the subterranean location of the perforating gun 58 to the surface location of the sample collecting system 48. The same U-tube 62 can be used for multiple operations, including the perforating operation, the flushing operation, and the sampling operation, as discussed in detail above.

Well Construction Architectures for Integrated Fluid Injection Monitoring

Figure 7:
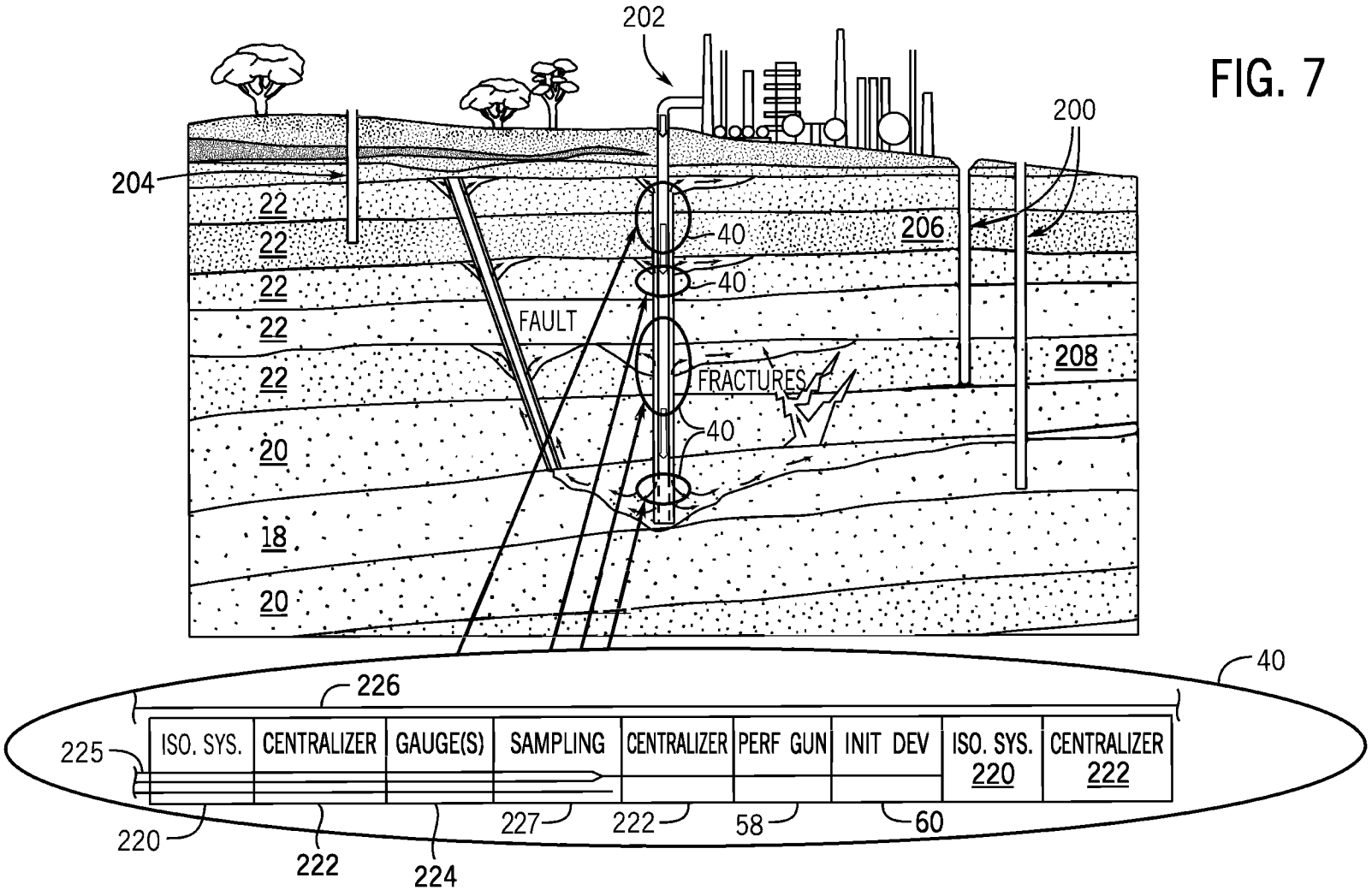
FIG. 7 is a schematic illustration of an embodiment of a well construction architecture for integrated fluid injection monitoring, in accordance with an aspect of the present disclosure.

In traditional carbon capture, utilization, and storage (CCUS) operations, monitoring and verification of $CO_2$ storage often involve installation and maintenance of dedicated monitoring wells 200 as shown in FIG. 7. These wells are used to assess integrity of storage site and detect any potential leaks of stored $CO_2$.

However, the installation and maintenance of these dedicated monitoring wells 200 can add significant costs to CCS projects. To address this issue, the present embodiments integrate monitoring systems within an injection well 202, placing these monitoring systems behind a casing which will reduce the number of dedicated monitoring wells 200. The injection well 202 may extend through multiple lithologies 18, 20, 22 to a reservoir depth within a confinement zone (e.g., below a sealing layer 20).

For traditional CCS operations, monitoring and verification of $CO_2$ storage involve the construction of one or more dedicated monitoring wells 200. Such monitoring wells may extend into one or more permeable zones, such as an underground source of drinkable water (USDW) monitoring well 204, an above confinement zone (ACZ) monitoring well 206, and an injection zone monitoring well 208. Samples and/or measurements from one or more of these zones may be monitored for regulatory compliance. For example, periodic collection of samples from the USDW and ACZ may be an acceptable approach for monitoring compliance.

The monitoring wells 200 are used to assess the integrity of the storage site and detect any potential leaks of stored $CO_2$ through cap rocks, faults, fractures or well bores. A monitoring plan may be developed to demonstrate that the site development deployed technologies will provide containment assurance and accounting of the $CO_2$ injected. This monitoring plan may includes monitoring: $CO_2$ volume and location in the reservoir, a pressure front created while injecting, the integrity of cap rock(s) 20, leaks around well bores, fluid invasion in ground water and USDW. Potential migration pathways of an injected fluid from an injection zone into other regions of a formation may include, but are not limited to, natural faults or fractures across layers of the formation, artificially formed fractures, subsidence faults from other injection or extraction operations, permeation through a permeable layer, leakage through a well (e.g., injection well, monitoring well, abandoned well). Monitoring and verification measures may detect and address any of the following risks: loss of field integrity over time, induced seismicity causing ground instability and damage to infrastructure, groundwater contamination, and public acceptance or perception of CCS.

Through the integration of monitoring capabilities directly into the injection wells 202, the need for separate dedicated monitoring wells 200 may be reduced. Additionally, the integration of all zonal measurements along an injection well 202 may reduce the overall cost of monitoring and verification. The integration may furthermore streamline the monitoring process, as data may be collected directly from all wells with a common technology. Moreover, reduction of supplemental monitoring wells 200 may reduce the footprint and cost of CCS operations. The monitoring technologies that may be integrated with hardware for an injection well include fluid sampling systems, pressure sensors, temperature sensors, distributed temperature sensing (DTS) lines (e.g., fiber optic lines), distributed acoustic sensing (DAS) lines (e.g., fiber optic lines), and one or more redundant lines for hydraulics, electrical power or communication, or fiber optic lines. The casing hardware that may be integrated with such monitoring technologies include, but are not limited to perforating guns, perforating gun accessories (power systems, batteries, control systems), packers, seals, formation sampling probes, pistons, stabilizers, centralizers, and cementing integrity subs, or any combination thereof.

Embodiments of the architecture for integrated fluid injection monitoring include combinations of systems for sampling, pressure, temperature, and fiber (DTS/DAS) measurements in one system. The monitoring system 40 may be deployed and repeated along one or more tubular strings (e.g. casing, liner, drill pipe, tubing). For example, the monitoring systems 40 may be installed on the casing string with or without cement.

As discussed above, the monitoring system 40 may include various components. FIG. 7 illustrates an embodiment of the monitoring system 40 with isolation systems, sensors or gauges, sampling systems, perforating guns, and centralizers. It is appreciated that the monitoring system 40 within a well (e.g., injection well 202, monitoring well 200) may include one or more iterations of the illustrated monitoring system, such as to acquire particular samples or to monitor particular conditions of the storage site. Moreover, the components of the monitoring system 40 illustrated in FIG. 7 are optional such that each iteration of the monitoring system 40 may include some components, yet omit other components. Furthermore, the ordering and arrangement of the components of the monitoring system may vary based on the formation characteristics, the hole geometry, and the desired monitoring plan. The monitoring system 40 may include an isolation system 220, such as a zonal isolation and sealing sub (ZISS), packers, and cement. One or more lines 225 may extend through components of the monitoring system 40 for use within the monitoring system or another monitoring system of the well. The one or more lines 225 may include monitoring lines (e.g., fiber optic, electric, and/or optical telemetry cables, monitoring cables, other monitoring lines), hydraulic sampling lines, electric control lines, or any combination thereof. For example, a set of lines 226 may extend through one monitoring system of a larger diameter casing to another monitoring system of a smaller diameter casing at a lower point in the well. Moreover the control lines for a perforating gun or the hydraulic lines for a sampling system may extend through the uphole isolation system and centralizer of a monitoring system.

The monitoring system 40 may include one or more centralizers 222. The one or more centralizers 222 are configured to position the monitoring system within an annular space of the well to facilitate operations with other components such as cementing, sealing measurement, monitoring, or perforating. In some embodiments, the monitoring system 40 may include one or more sensors or gauges 224. The gauges 224 may include, but are not limited to the gauges 74 described above. In some embodiments, the one or more control lines 225 may facilitate monitoring measurements, such as via distributed temperature sensing (DTS) or distributed acoustic sensing (DAS). The monitoring system 40 may include a sampling system 227 as described above. Moreover, the monitoring system 40 may include the perforating gun 58 and initiating device 60 described above.

Embodiments of the monitoring system 40 and well construction architecture for integrated fluid injection monitoring may facilitate positioning of monitoring and sampling systems on tubing or casing. Moreover, embodiments of the monitoring system 40 and well construction architecture for integrated fluid injection monitoring may enable multiple zones to be monitored and/or sampled while maintaining zonal isolation between layers of the formation. For example, monitoring systems described herein may enable monitoring of the USDW and ACZ from the injection well with fewer (or even none) special-purpose monitoring wells. Furthermore, the monitoring systems described herein may be used with one or more zonal isolation systems, including casing packers, open-hole packers, and cemented sections, among others.

Expandable Metal Packer System with Bypass

The following discussion relates to a dual expandable metal packer system with bypass to isolate a zone during well cementing. The system does not need a stage cementing tool. The system can be equipped with control lines as well as sensors can be placed in the isolated/uncemented zone.

Figure 8:
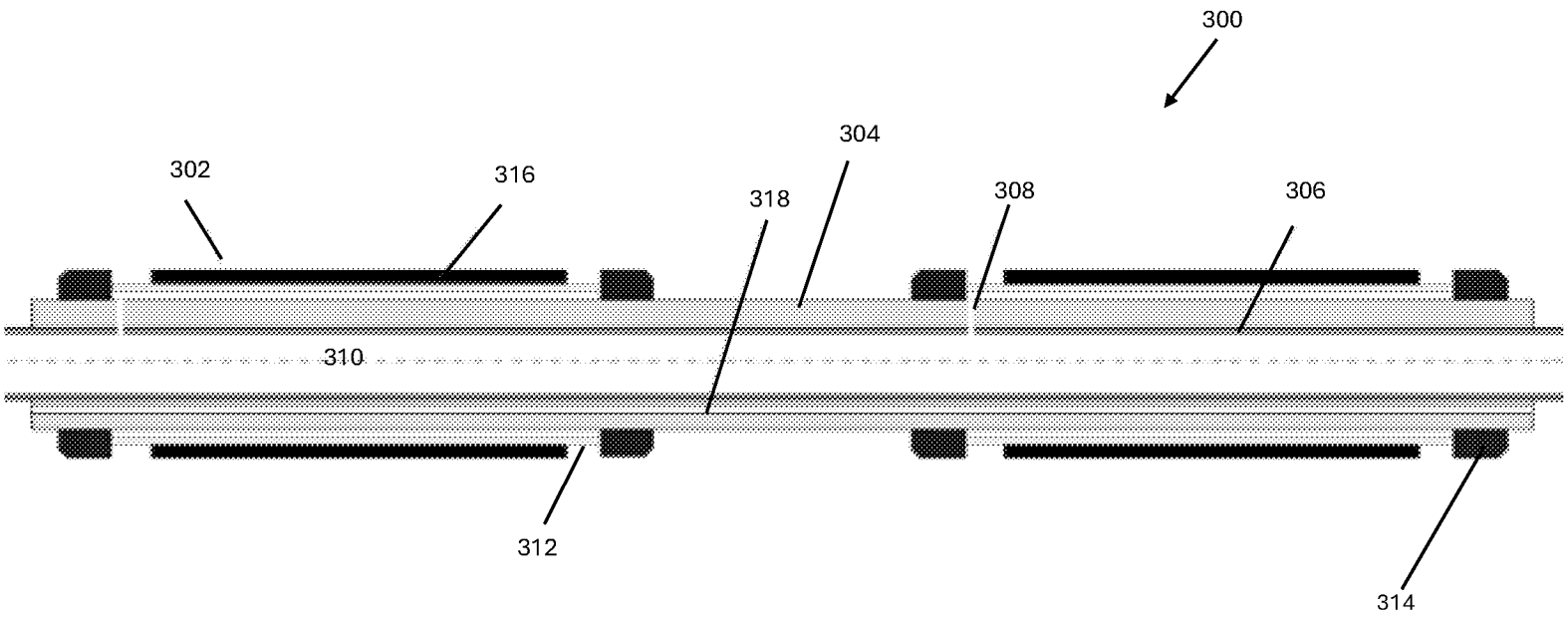
FIG. 8 is a schematic illustration of an expandable metal packer system for use with the monitoring system, in accordance with an aspect of the present disclosure.

The dual expandable packer system 300 is observed in FIG. 8, comprising expandable packers 302 located on the outer surface of a mandrel 304. The mandrel is positioned on the outer surface of a liner 306. FIG. 8 illustrates the dual expandable metal packer system 300 in a run-in-hole (RIH) configuration. The two expandable packers 302 are spaced apart on the mandrel 304 creating an isolated zone therebetween when the expandable packers 302 are inflated. The two expandable packers are characterized as an upper expandable packer 302 and a lower expandable packer 302. Each expandable packer 302 comprises a port 308 utilized to inflate the expandable packer via internal fluid pressure. The port 308 extends from a bore 310 of the liner 306 to the expandable packer 302. The port 308 may have a pressure control device, e.g. a one way valve, utilized to inflate the expandable packer 302. The pressure control device will allow fluid to enter the expandable packer 302 but prohibits fluid from exiting the expandable packer 302. The pressure control device controls the pressures utilized to inflate the expandable packer 302.

The certain embodiments, packer 302 is a deformable metal sleeve 312. The metal sleeve 312 is attached to end caps 314 located at each axial end of the metal sleeve 312. On the outer surface of the metal sleeve is an elastomer 316 that makes an annular sealing layer. The elastomer 316 creates a seal against the surrounding wellbore wall when the metal sleeve 312 is radially expanded. The elastomer 316 is deformable to mimic the wellbore wall and form a seal. Additionally, the wellbore may be open hole or lined with casing.

The dual expandable packer system 300 has a bypass passage 318. The bypass passage 318 is a flow path that allows fluid or cement to pass from a bottom side of lower expandable packer 302 to a top side of the upper expandable packer 302. The bypass passage 318 may be created by longitudinal holes in the mandrel 304. The bypass passage 318 may be created by a gap between the liner 306 and the mandrel 304. The bypass passage 318 can be concentric or eccentric.

In embodiment, the dual expandable packer system 300 can be equipped with one or more control lines. The control lines can be electric, fiber optic, hydraulic lines or any other type of control line. The control lines can be run through one or more longitudinal holes located in the mandrel 304. Additionally, the control lines can be run through the gap located between the mandrel 304 and the liner 306. The control lines can run through the whole system or stop at the isolated zone between the two expandable packers 302. Sensors can be placed in the isolated zone between the two expandable packers 302. The control lines may provide power supply or read the sensors placed in-between the two expandable packers 302. The hydraulic control lines can be used to extract fluid sampling in the isolated area defined between the two expandable packers 302. In another embodiment, the hydraulic lines can supply the fluid pressure from the surface needed to expand the expandable packers 302, eliminating the need for the port 308 in the well tubular structure. Additionally, the dual expandable packer system 300 can have both control lines and ports 308, wherein either the control lines or ports 308 is considered a primary inflation system for the expandable packer 302. The control lines or port 308 that is not considered the primary inflation system will be the backup inflation system in the event the primary system does not function properly.

Figures 9A, 9B, 9C, 9D, 9E, 9F:
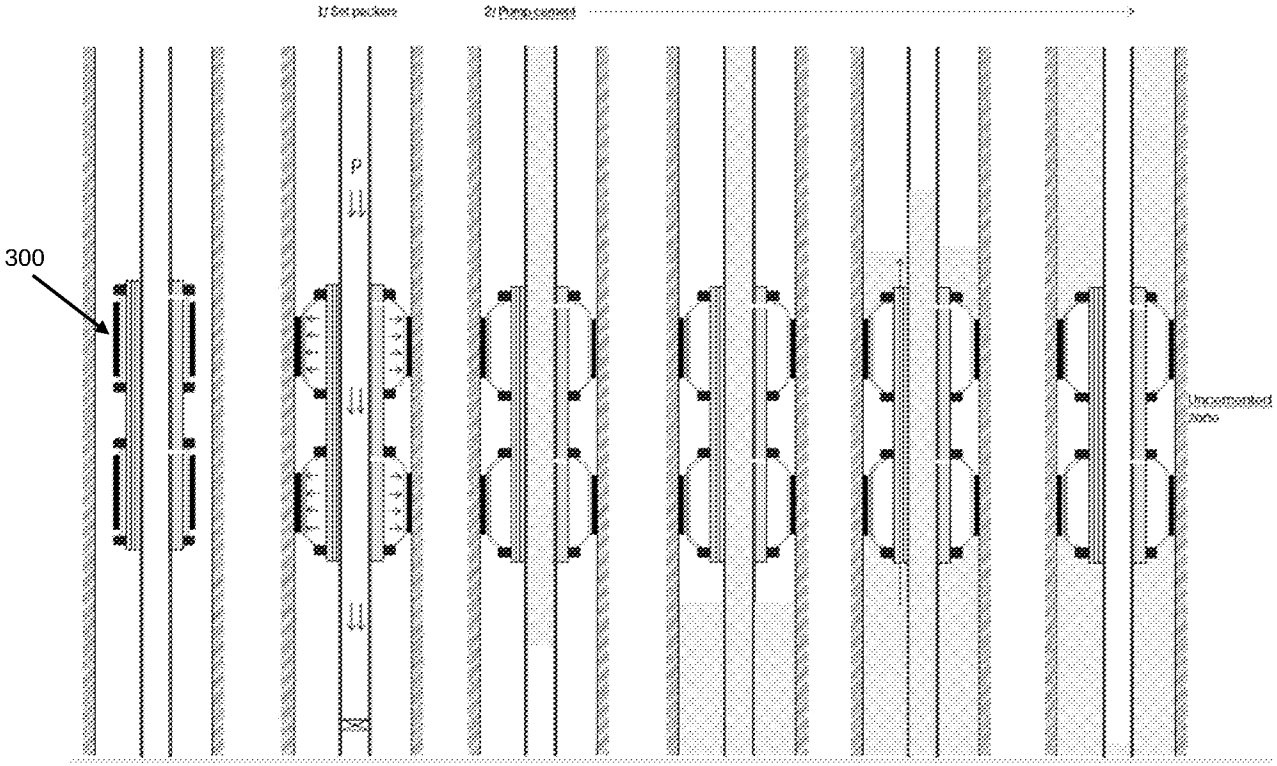
FIG. 9A-9F illustrates six stages of cementing an annulus created by the dual expansion packer system with a fluid bypass passage and wellbore wall.

In operation, the dual expandable packer system 300 is run in hole to a desired location in the initial RIH position as illustrated in FIG. 9A. Once the dual expandable packer system 300 is delivered to a desired position, a preset fluid pressure may be conveyed through the bore 310 of the liner 306. The fluid will enter the ports 308 of each expandable packer 302 causing the expandable packers 302 to inflate, creating a seal with the wellbore wall. The preset fluid pressure is illustrated by the arrows in FIG. 9B. Additionally, the isolated zone between the two inflated expandable packers 302 is illustrated in FIG. 9B.

Once the dual expandable packer system 300 has been set, a cement slurry is conveyed through the liner 306 and up the annulus as shown in FIG. 9C-F. When the cement slurry reaches the lower expandable packer, the cement slurry will travel through the bypass passage 318 of the dual expandable packer system 300 into the annulus above the dual expandable packer system 300 as shown in FIG. 9E-F. The isolated zone is an uncemented zone in the annulus as shown FIG. 9F. This section of the annulus may be the only section that is not cemented around the packer system 300. This section can be monitored by the sensors installed within the isolated zone. The sensors can determine if the dual expandable packer system 300 is compromised by detecting a leak in the isolated section. Additionally, or in the alternative, sensors in the isolated section may detect and/or sample fluid from the formation. For example, sensors in the isolated section may be used to monitor $CO_2$ or another injected fluid within the formation, as discussed above.

The subject matter described in detail above may be defined by one or more clauses, as set forth below.

A system includes a casing configured to mount within an open hole of a wellsite and a monitoring system configured to mount outside of the casing and monitor a geological formation. The monitoring system includes a perforating device outside of the casing, where the perforating device is configured to produce one or more perforations into the geological formation outside of the casing in a perforating operation of the monitoring system, where the one or more perforations are configured to enable fluid flow between the geological formation and the monitoring system. The system also includes a fluid circuit outside of the casing, where the fluid circuit is coupled to the perforating device, and the fluid circuit is configured to route a first fluid from the geological formation to a sample collecting system during a sampling operation of the monitoring system.

The system of any preceding clause, including the sample collecting system configured to analyze one or more properties of the first fluid.

The system of any preceding clause, where the sample collecting system is configured to analyze the one or more properties of the first fluid to evaluate an integrity of a fluid reservoir in the geological formation.

The system of any preceding clause, where the fluid reservoir includes carbon dioxide ($CO_2$).

The system of any preceding clause, where the fluid circuit includes a U-tube coupled to a fluid supply.

The system of any preceding clause, where the fluid circuit includes a sampling conduit coupled to the U-tube and the perforating device.

The system of any preceding clause, where the fluid circuit includes one or more sensors or gauges.

The system of any preceding clause, where the fluid circuit includes a filter.

The system of any preceding clause, where the filter is disposed along the sampling conduit, the fluid circuit includes a flush conduit coupled to the U-tube and the sampling conduit, and the flush conduit comprises a check valve.

The system of any preceding clause, where the fluid circuit includes an actuation conduit coupled to the U-tube and the perforating device, and the fluid supply is configured to supply an actuation fluid to the perforating device to activate the perforating operation.

The system of any preceding clause, where the actuation conduit includes a check valve.

The system of any preceding clause, where the perforating device includes an initiation device coupled to a perforating gun, the initiation device is configured to activate the perforating gun to produce the one or more perforations, and the initiation device includes a fluid actuator, an electronic actuator, a mechanical actuator, or a combination thereof.

The system of any preceding clause, including a controller coupled to the monitoring system, where the controller includes a processor, a memory, and instructions stored on the memory and executable by the processor to activate the perforating device to produce the one or more perforations and operate a fluid supply to supply a second fluid to help route the first fluid from the geological formation to the sample collecting system.

A system includes a monitoring system configured to mount outside of a casing within an open hole of a wellsite and monitor a geological formation. The monitoring system includes a perforating device outside of the casing, where the perforating device includes an initiation device configured to activate a perforating gun to produce one or more perforations into the geological formation outside of the casing in a perforating operation of the monitoring system, where the one or more perforations are configured to enable fluid flow between the geological formation and the monitoring system. The system also includes a fluid circuit outside of the casing, where the fluid circuit is configured to route a first fluid from the geological formation to one or more sensors or gauges to monitor one or more properties of the first fluid.

The system of any of the preceding clauses, including a sample collecting system coupled to the fluid circuit, where the sample collecting system is configured to analyze the one or more properties of the first fluid to evaluate an integrity of a fluid reservoir in the geological formation during a sampling operation of the monitoring system.

The system of any of the preceding clauses, where the initiation device includes a fluid actuator coupled to the fluid circuit.

The system of any of the preceding clauses, where the fluid circuit includes a U-tube coupled to a fluid supply and the perforating gun, and a controller is configured to operate the fluid supply to increase a fluid pressure in the fluid circuit during the perforating operation to activate the perforating gun, and the controller is configured to operate the fluid supply to decrease the fluid pressure in the fluid circuit during a sampling operation of the monitoring system.

A method for operating a monitoring system to sample a first fluid includes, in a perforating operation of the monitoring system, increasing a pressure of a second fluid within a U-tube of the monitoring system to activate a perforating device of the monitoring system, where upon activation of the perforating device, a perforating gun of the perforating device is configured to produce one or more perforations extending from the perforating gun into a geological formation. The method also includes, after the perforating operation of the monitoring system, sampling, via a sampling operation of the monitoring system, where the sampling operation includes decreasing the pressure of the second fluid within the U-tube of the monitoring system to enable flow of the first fluid from the geological formation into the monitoring system.

The method of any of the preceding clauses, where at least a portion of the monitoring system is disposed within a cemented annulus, where the cemented annulus is radially between a casing of a wellbore and a wall of an open hole.

The method of any of the preceding clauses, where in the sampling operation, the monitoring system is configured to direct the first fluid to a sample collecting system, where the sample collecting system is configured to perform an analysis of the first fluid.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

a casing configured to mount within an open hole of a wellsite;

a sample collecting system configured to analyze one or more properties of a first fluid; and a monitoring system configured to mount outside of the casing and monitor a geological formation, wherein the monitoring system comprises:

a perforating device outside of the casing, wherein the perforating device is configured to produce one or more perforations into the geological formation outside of the casing in a perforating operation of the monitoring system, and wherein the one or more perforations are configured to enable fluid flow between the geological formation and the monitoring system; and a fluid circuit outside of the casing, wherein the fluid circuit comprises:

a U-tube coupled to a fluid supply:

a sampling conduit coupled to the U-tube and the perforating device;

a filter, wherein the filter is disposed along the sampling conduit; and a flush conduit coupled to the U-tube and the sampling conduit, wherein the flush conduit comprises a check valve, wherein the fluid circuit is coupled to the perforating device, and wherein the fluid circuit is configured to route the first fluid from the geological formation to the sample collecting system during a sampling operation of the monitoring system.

2. The system of claim 1, wherein the fluid circuit comprises one or more sensors or gauges.

3. The system of claim 1, wherein the fluid circuit comprises an actuation conduit coupled to the U-tube and the perforating device, and wherein the fluid supply is configured to supply an actuation fluid to the perforating device to activate the perforating operation.

4. The system of claim 3, wherein the actuation conduit comprises an additional check valve.

5. The system of claim 1, wherein the perforating device comprises an initiation device coupled to a perforating gun, wherein the initiation device is configured to activate the perforating gun to produce the one or more perforations, and wherein the initiation device comprises a fluid actuator, an electronic actuator, a mechanical actuator, or a combination thereof.

6. The system of claim 1, comprising a controller coupled to the monitoring system, wherein the controller comprises a processor, a memory, and instructions stored on the memory and executable by the processor to activate the perforating device to produce the one or more perforations and operate the fluid supply to supply a second fluid to help route the first fluid from the geological formation to the sample collecting system.

7. A system, comprising:

a monitoring system configured to mount outside of a casing within an open hole of a wellsite and monitor a geological formation, wherein the monitoring system comprises:

a perforating device outside of the casing, wherein the perforating device comprises an initiation device configured to activate a perforating gun to produce one or more perforations into the geological formation outside of the casing in a perforating operation of the monitoring system, and wherein the one or more perforations are configured to enable fluid flow between the geological formation and the monitoring system; and a fluid circuit outside of the casing, wherein the fluid circuit comprises:

a U-tube coupled to a fluid supply;

a sampling conduit coupled to the U-tube and the perforating device;

a filter, wherein the filter is disposed along the sampling conduit; and a flush conduit coupled to the U-tube and the sampling conduit, wherein the flush conduit comprises a check valve, and wherein the fluid circuit is configured to route a first fluid from the geological formation to one or more sensors or gauges to monitor one or more properties of the first fluid.

8. The system of claim 7, wherein the initiation device comprises a fluid actuator coupled to the fluid circuit.

9. The system of claim 8, wherein the fluid circuit comprises a controller configured to operate the fluid supply to increase a fluid pressure in the fluid circuit during the perforating operation to activate the perforating gun, and wherein the controller is configured to operate the fluid supply to decrease the fluid pressure in the fluid circuit during a sampling operation of the monitoring system.

* * * * *